US006070873A

United States Patent [19]

Perkins

[11] Patent Number: 6,070,873

[45] Date of Patent: Jun. 6, 2000

[54] CARD GAME AND METHOD OF PLAYING CARD GAME

[76] Inventor: Thomas Francis Perkins, 6460 Chickasaw Dr., Douglasville, Ga. 30135-4616

[21] Appl. No.: 09/041,874

[22] Filed: Mar. 12, 1998

Related U.S. Application Data

[60] Provisional application No. 60/041,217, Mar. 14, 1998.

[51] Int. Cl.[7] ..... A63F 1/00

[52] U.S. Cl. ..... 273/292; 273/303; 434/129

[58] Field of Search ..... 273/292, 303; 434/129

[56] References Cited

U.S. PATENT DOCUMENTS

| | | | |
|---|---|---|---|
| 5,098,107 | 3/1992 | Boylan et al. | 273/292 |
| 5,413,353 | 5/1995 | Demarest et al. . | |
| 5,431,407 | 7/1995 | Hofberg et al. . | |
| 5,431,408 | 7/1995 | Adams . | |
| 5,437,451 | 8/1995 | Fulton . | |
| 5,465,975 | 11/1995 | Shull et al. . | |
| 5,538,252 | 7/1996 | Green | 273/292 |
| 5,743,532 | 4/1998 | Lafferty | 273/292 |
| 5,820,128 | 10/1998 | Brunelle | 273/292 |
| 5,839,732 | 11/1998 | Guidi | 273/292 |

OTHER PUBLICATIONS

Scarne's Encyclopedia. John Scarne. "Five–Card Stud Poker and Three–Card Substitution". pp. 33–39, Mar. 1973.

*Primary Examiner*—Robert A. Hafer

*Assistant Examiner*—Bena B. Miller

*Attorney, Agent, or Firm*—Wilburn L. Chesser; Jones Jain, L.L.P.

[57] ABSTRACT

A card game and method of playing a card game that enables a player to purchase an option to buy a bonus card to better the player's hand. The method of playing the game includes a dealer accepting an optional insurance fee from each player of the game who chooses to pay the optional insurance fee and accepting a first wager from each player. The dealer then deals a selected number of cards to each player. After dealing these cards to each player, the dealer allows each player to elect in turn to place an additional wager. If a player does not place an additional wager when requested by the dealer, the player folds and is no longer in the game. The dealer then deals cards to each player who elects to place additional wagers. After the dealer has dealt each player a standard number of cards, the dealer deals a bonus card to each player who paid an insurance fee and who has a losing hand. After bonus cards have been dealt, the dealer determines if the cards, including the bonus card if the bonus card was dealt, of each player yield a combined rank that equals or exceeds a preselected winning rank. The players are paid a winning sum if the combined rank equals or exceeds the preselected winning rank.

15 Claims, 4 Drawing Sheets

CARD GAME AND METHOD OF PLAYING CARD GAME

This application claims benefit of Provisional Application No. 60/041,217 filed Mar. 14, 1998.

FIELD OF THE INVENTION

The present invention relates to a card game and particularly a poker-type card game.

BACKGROUND OF THE INVENTION

Card games have been enjoyed all over the world and serve as a means for relaxation and recreation for many people. Card games which are easy to learn and which can be quickly played are very popular. Such games include "blackjack" and "poker." In these type games, a dealer usually deals the cards to the player and monitors the player's request for additional cards if desired by the player.

Many of these well-known games are played in a casino where the players involved wager various amounts of money to add to the excitement of playing the game or to attempt to earn large sums of money. One of the most popular games in which players wager money is poker. Poker is typically played with a standard deck of playing cards. In poker, a dealer provides cards to each of several players and the players collect the cards and try to form the best possible combination of cards according to a predetermined ranking of the combination of cards. The combinations or rank of cards are based on numerical values of the cards and the suits of the cards. The general object of poker is for a player to achieve a five card hand having a higher rank than the hands held by the player's opponents. The basic rank or hierarchy of a poker hand in order of descending superiority is: royal flush, straight flush, four of a kind, full house, flush, straight, three of a kind, two pair, one pair, and high cards in hand.

One type of poker game is known as "Draw" Poker. In Draw Poker, a player may discard a certain number of cards and the cards discarded by the player are replaced with cards from the dealer. Typically, the number of cards that a player discards is limited. Often, in draw poker, a player is restricted to replacing only three cards in the player's hand. Another type poker game is "Stud Poker." In Stud Poker, a player is provided with five cards from the dealer. The players competing against each other are given multiple chances to increase the amount of their wager necessary for other players to stay in the game. For example, if one player places a wager of a certain amount, in order for other players to stay in the game, the other players must match or increase the wager placed by the initial waging player. Also, in Stud Poker, players may separately play against a dealer or try to attain a predetermined rank of cards. In games where the object is to beat a predetermined rank, the winning payouts for beating a particular rank are inversely proportional to the probability of attaining the particular winning hand.

While these games have been popular in the home environment and in casinos, there is a need for a poker type game that may be quickly played and which provides options to a player that can make a poker game more interesting to the player.

SUMMARY OF THE INVENTION

Generally described, the present invention provides a card game and method of playing a poker-type card game which enables a player to purchase an option to buy a bonus card to better the player's hand. The purchase of the bonus card is typically purchased after the dealer makes an initial determination as to whether the player has a winning hand after a predetermined number of cards is dealt.

Particularly, the method of playing the game includes a dealer accepting an optional insurance fee from each player of the card game who chooses to pay the optional insurance fee and accepting a first wager from each player. The dealer then deals a selected number of cards to each player. After dealing these cards to each player, the dealer allows each player to elect in turn to place an additional wager. If a player does not place an additional wager when requested by the dealer, the player folds and is no longer in the game. The dealer then deals cards to each player who elects to place additional wagers. After the dealer has dealt each player a standard number of cards, the dealer deals a bonus card to each player who paid insurance fees and who has a losing hand. After bonus cards have been dealt, the dealer determines if the cards, including the bonus card if the bonus card was dealt, of the player yield a combined rank that equals or exceeds a preselected winning rank. The players are paid a winning sum if the combined rank equals or exceeds the preselected winning rank.

The invention may also include dealing a community card face-up so that all players can view the value of the card. The community card is included as a card of the standard number of cards dealt and is used in combination with other cards held by a user to determine whether the user has a winning hand. Preferably, the bonus card is dealt to the player who purchased the optional insurance only if the cards dealt to this player in combination with the community card do not yield a combined rank that equals or exceeds the preselected winning rank. The dealer preferably collects all insurance fees regardless of whether a player beats the predetermined rank. A game table used for playing the card game may include indicia for indicating the position of placement of an insurance fee. The game table may also include indicia for indicating a position on the game table for the placement of a community card and indicia for indicating a position on the game table for the placement of the bonus card.

Thus, it is an advantage of the present invention to provide a method of playing a poker-type card game that provides various options to a player to purchase an additional card after a certain number of cards has been dealt to a player.

Other advantage will be apparent to those skilled in the art upon a review of the discussion herein and the accompanying drawings.

DETAILED DESCRIPTION OF THE INVENTION

Figure 1:
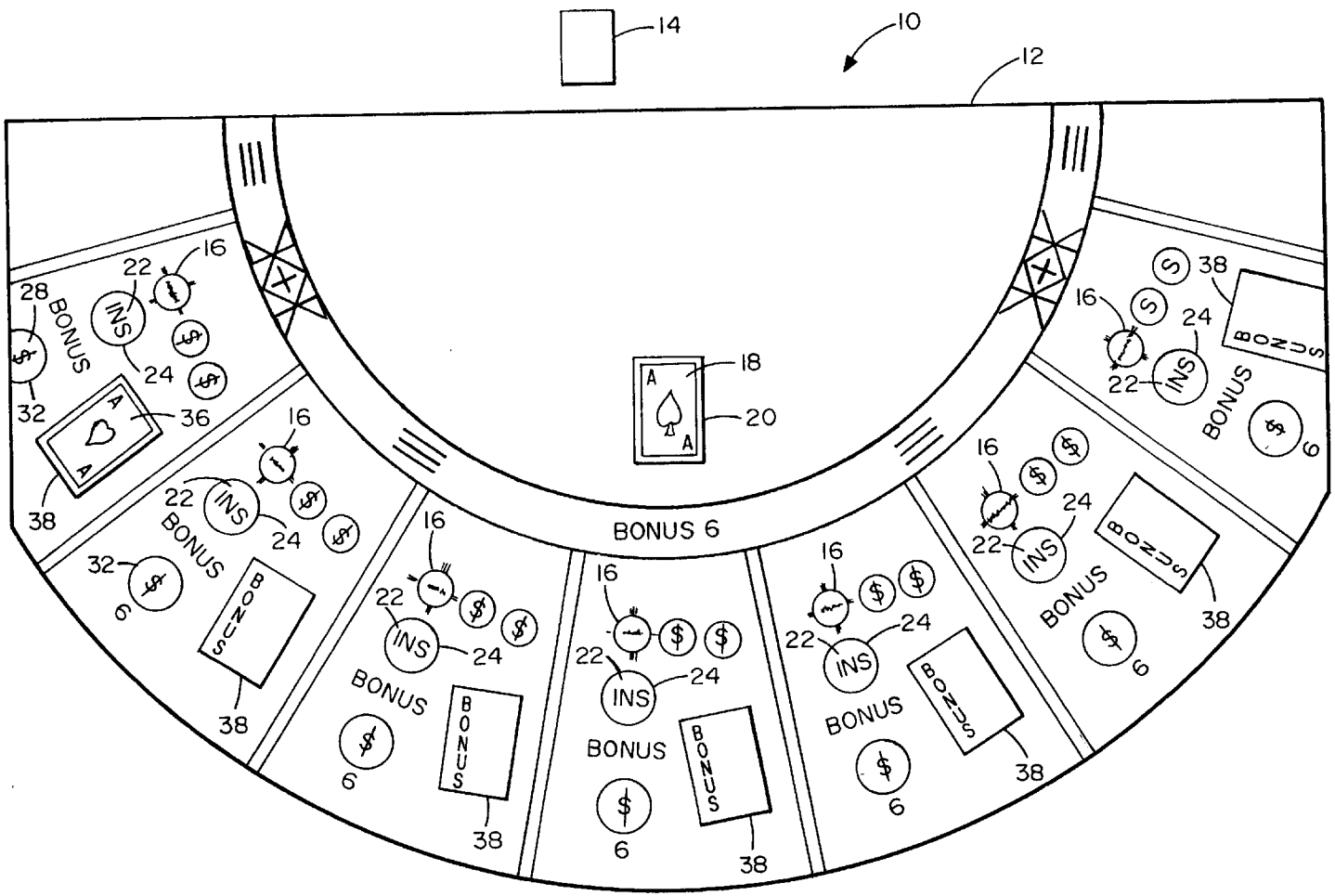
FIG. 1 is a diagram of the playing table used in connection with the present invention.

Referring to FIG. 1, a table 12 constructed for use with the card game 10 of the present invention is illustrated. The card game 10 is preferably played with a single standard 52-card deck 14. In the table illustrated, seven players may play. A player tries to make the best five-card poker hand out of either five or six cards dealt. The amount of money that a player may win is determined by the player's ante 16. A community card 18 is dealt face-up in the center of the table 12 at a community card position 20. The cards 14 dealt to a player are combined with the community card 18 at the community card position 20 to form the poker hand for the player. A player may receive a bonus card after a five-card hand is completed in connection with the community card 18 if the player elected at the beginning of the card game to pay an insurance fee 22. Preferably, the player can only elect to receive a bonus card if the player originally has a losing hand. The insurance fee 22 is positioned at a designated insurance fee position 24. When a player desires to purchase a bonus card 36, the player provides a bonus ante 28 which is positioned to the bonus ante position 32. The dealer may then deal the bonus card 36 at the bonus card position point 38. It should be appreciated by those skilled in the art that the invention may be practiced at a card table with the printed indicia shown or within a computer system which generates printed indicia or graphics that displays the pertinent elements of the invention and processes the players choices according to the description provided herein.

The steps of the preferred method of playing the game of the present invention are discussed in the following numbered paragraphs.

1. The deck is replenished and shuffled by a dealer.

2. Before any cards are dealt, each player places a wager or an ante 16 on the appropriate circle on the table. The ante 16 is preferably at least as large as the house minimum ante and not larger than the house maximum. The size of the player's ante 16 is referred to herein as "one unit."

3. Each player is invited, at his or her discretion, to pay an optional insurance fee of ½ unit (½ of the player's ante) to "insure" the hand. This decision is preferably made before any cards are dealt and the fee may not be taken back after dealing commences. The insurance fee 22 gives the player the option of buying a sixth card for his hand if he has a losing hand after the player attains a five card hand.

4. Once all bets have been placed and the dealer announces "No More Bets," the dealer discards the top card and begins the deal. Each player receives two cards dealt face down from the dealer. The dealer then places a single community card 18 face up in the designated community card position 20 in the center of the table. The dealer may deal the community card immediately after dealing each player an initial card face down. Each player should keep their cards hidden from the other players. The community card 18 remains where each player can see it.

5. The players now decide to play or fold. The player's two cards plus the community card makes a three-card hand. Each player decides, based on these three cards, whether to fold or to wager an additional unit. To continue, the player places a second bet equal to the ante bet. If the player bets, the bet is preferably the same size as his original ante. A player who chooses not to bet gives up his cards to the dealer and money wagered to the house, including the insurance fee, and he sits out the remainder of the game.

6. Prior to dealing the third card to the player, "No More Bets" is announced by the dealer. The dealer discards the top card from the deck. Each player who bets in step (paragraph) 5 receives an additional card dealt face down. All remaining players now hold three cards. A player's three private cards plus the single community card 18 makes a 4-card hand. Again each player decides whether to fold or to bet one additional unit. The bet again is preferably, the same size as the ante. A player that does not bet folds. The player gives up his cards and all money wagered to the house.

7. Prior to dealing the fourth card to the player, "No More Bets" is announced by the dealer. The dealer discards the top card from the deck. Each player that bet in step 6 receives a fourth card dealt face down. Each remaining player now holds four cards. The community card combined with the four cards in the player's hand form a five card poker hand. The players still in the game mentally combine their four cards with the community card without touching the community card to form the 5-card poker hand.

8. The dealer discards the top card from the deck. If the 5-card hand of the player is a losing hand—meaning the hand is not at least a pair of 6s or better (according to the standard ranking of poker hands) and if the player paid the insurance fee 22 at the beginning of the game, then the player may, at his or her discretion, purchase a sixth card (the "Bonus 6" card) for the hand. The cost of the purchase is one unit (the same size as the player's ante). The money that buys insurance and the Bonus 6 card is a fee—the money goes to the house regardless of whether or not the player ends up with a winning hand. However, the ante and the two bets made in steps 5 and 6 are wagers—this money is returned to the player if the player wins.

9. After all eligible players have decided whether or not to buy a Bonus 6 card, all players turn over their cards. The dealer verifies that the players that paid for a sixth card were in fact eligible to do so, and then deals the Bonus 6 cards. A player with a six-card hand mentally forms the best possible 5-card poker hand contained within the six cards. The players should not touch either the community card or the Bonus 6 cards, and in particular they may not commingle their Bonus 6 card with the rest of their hand. This aids the dealer or supervisors in detecting mistakes.

10. Each player still in the game has a total of three units wagered on his hand. If a player does not have at least a pair of 6s or better, then he loses all three of his wagers to the house. If he has a winning hand, then his three wagers are returned to him and he is paid additional money (on all three wagers) determined by a pay-table. For example, if the player has a pair of 6s, then he is paid at 1-1 odds on his three wagers, or three units. Regardless of whether the player ended with a winning or a losing hand, the ½ unit insurance fee and the cost of buying the Bonus 6 card goes to the house and is not returned to the player.

A player does not have to beat the hands of other players or have to beat a hand of the dealer. A player wins if the player's hand equals or exceeds a preselected rank which is preferably a pair of 6s.

Pay Table

A pay table that may be used for this game is given below.

PAY TABLE #1

| Hand-type | Odds to one | Amount Paid |
|---|---|---|
| Pair 6+ | 1 | 3 |
| Two Pair | 2 | 6 |
| Triplets | 3 | 9 |
| Straight | 4 | 12 |
| Flush | 6 | 18 |
| Full House | 20 | 60 |
| 4 of a Kind | 50 | 150 |
| Straight Flush | 100 | 300 |
| Royal Flush | 1,000 | 3,000 |

Example of Expected Return

On a single hand, the player's net profit is the (Amount of money received from the casino)−(Amount of money paid to the casino). For example, if the player makes an ante of one unit and then folds the hand before making another bet, then her net profit on that hand is −1. If the player doesn't pay the insurance fee, plays the hand to five cards and ends with a pair of 6s, then her profit is +3. If she pays the insurance fee and gets a pair of 6s with 5 cards, her profit is +2.5. If she pays the insurance fee and gets a losing hand with 5 cards, but then buys the Bonus 6 card and gets a pair of 8s, then her profit is +1.5. If she buys the Bonus 6 card and gets a pair of five's, then her profit is −4.5 units.

Processes

Figure 2A:
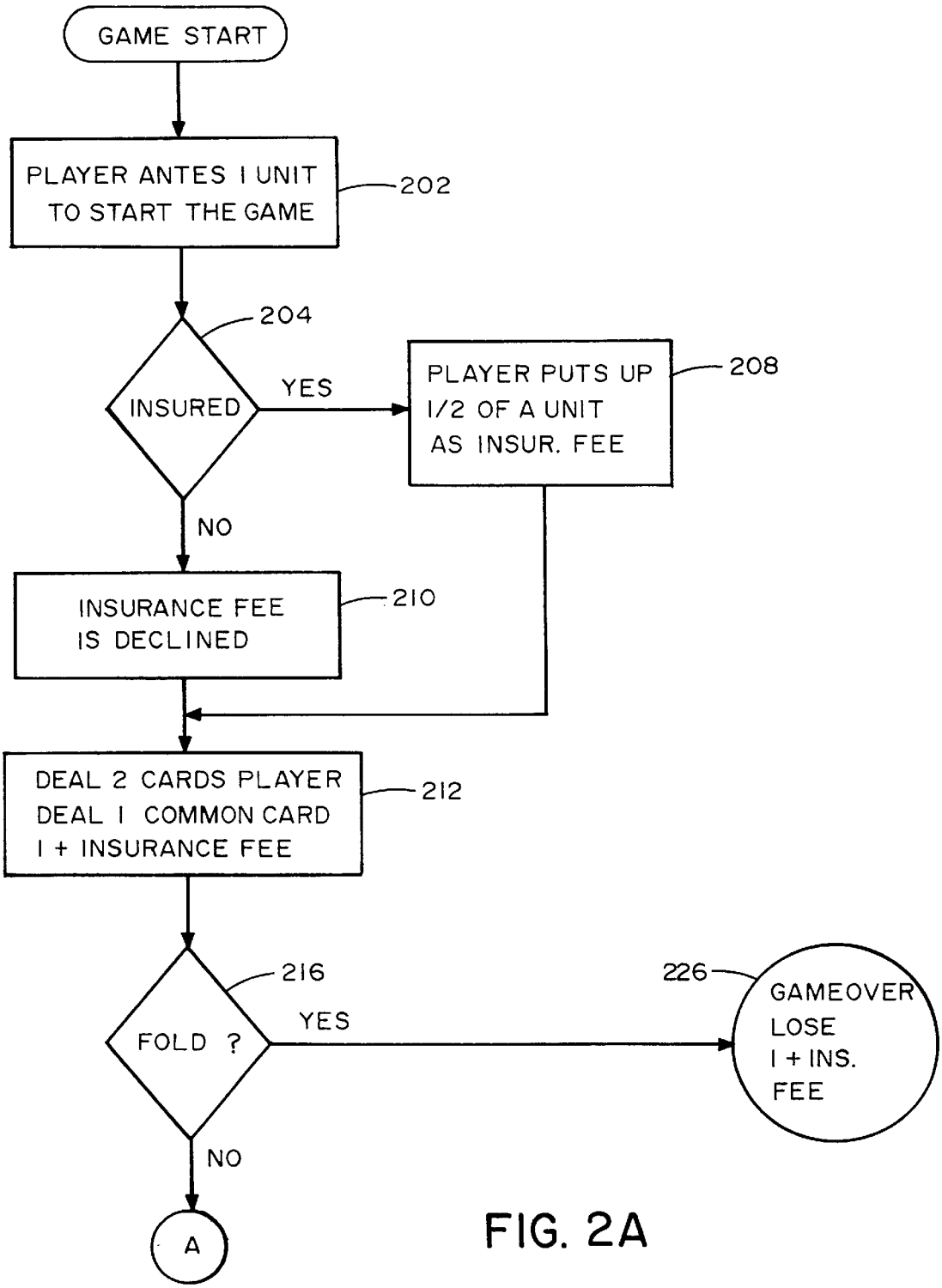
FIGS. 2*a*, 2*b*, and 2*c* are flow diagrams of the steps of the game of an embodiment of the present invention.
Figure 2B:
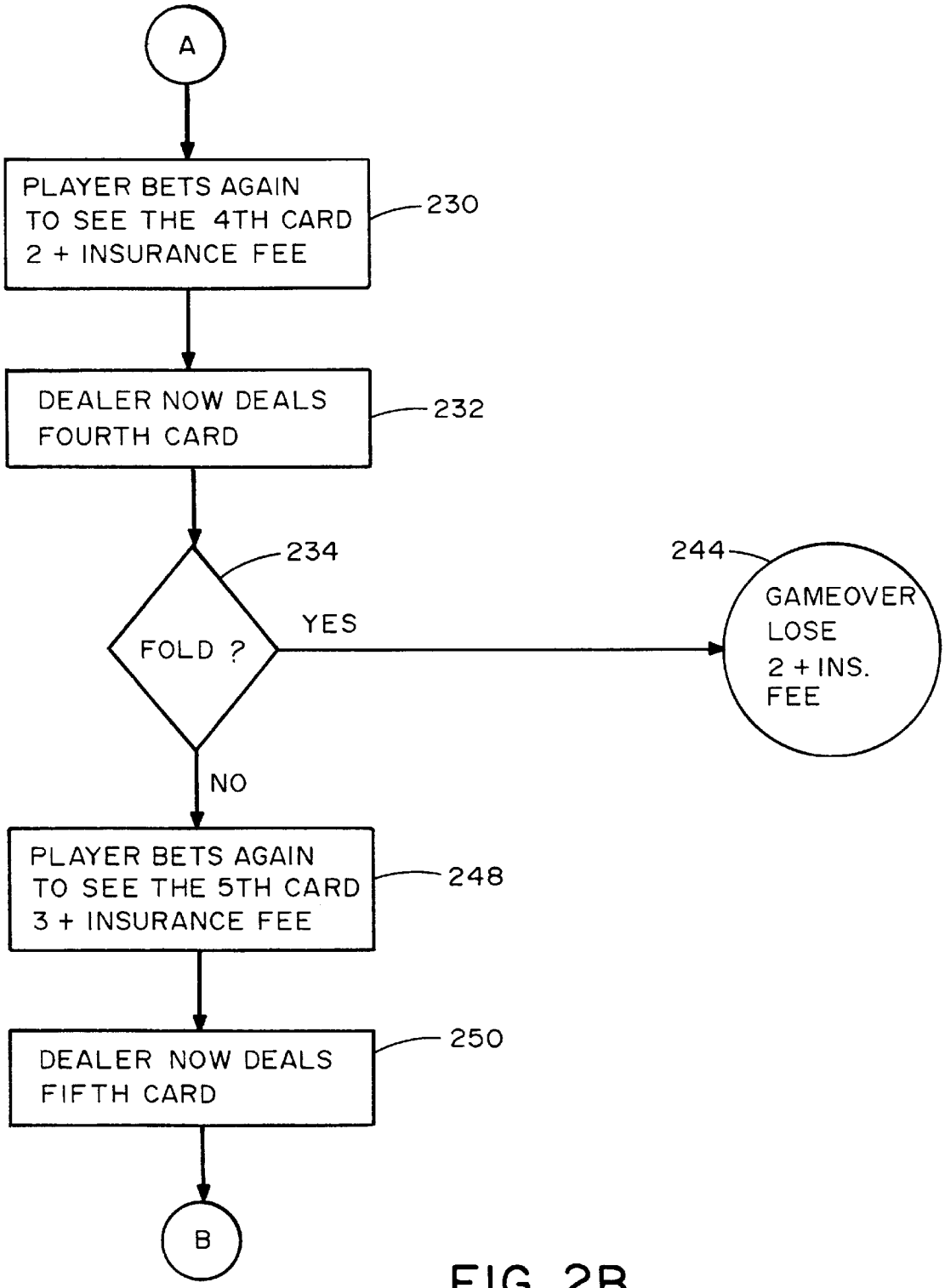
Figure 2C:
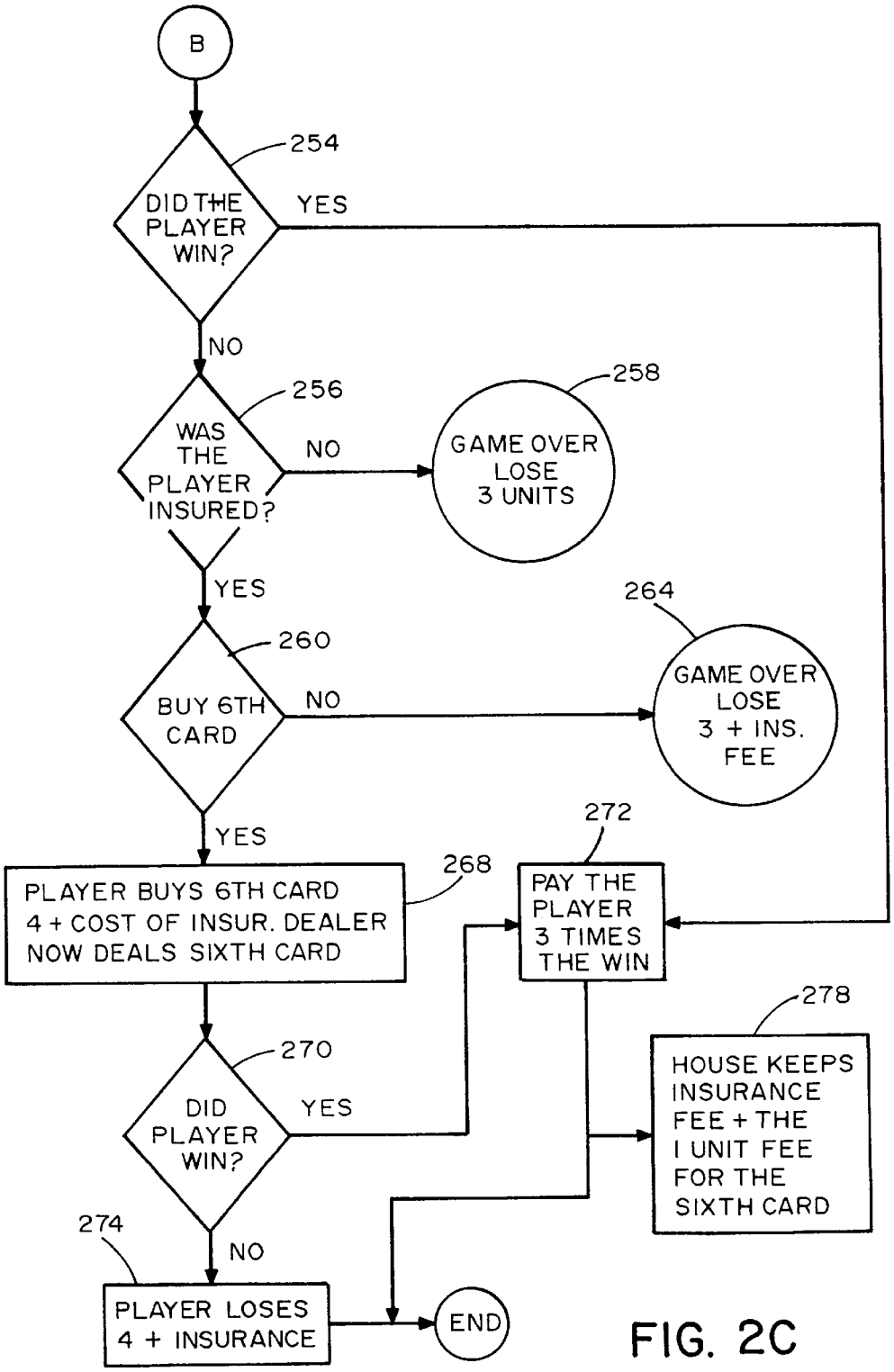

Referring to FIGS. 2*a*, 2*b*, and 2*c*, a flow diagram of the processes implemented in conjunction with the present invention is illustrated. It should be appreciated that the processes discussed in connection with FIGS. 2*a*, 2*b*, and 2*c*, may be implemented in a computer system which executes program modules to perform the steps discussed. It should be appreciated by those skilled in the art that computer program routines of a computer system may be used to generate the graphics necessary to display cards and user's options and to accept bets and generate payouts. In a computer system, various program routines may be used to execute the steps of the present invention. For example, a randomizing routine may be used to shuffle cards of a graphically displayed card deck. The computer system then requests the payment of the optional insurance fee and placement of a wager. Such requests can be made by a voice synthesizer or by generated text. A computer program module then causes cards to be dealt to the player and causes a community card to be dealt as discussed herein. A computer routine generates requests for additional wagers and accepts options as discussed herein. A player may indicate the player's choices for options by pressing input keys associated with the computer system and by inputting money in a designated slot. Computer routines monitor input indicators to process a player's responses. In response to a player's selected option, the computer program modules execute the steps of the invention as discussed herein.

At step 202, the player is invited to place an ante by the dealer and the player provides the ante to begin play. At step 204, the player is offered the option of purchasing insurance in order to purchase a bonus card if desired. If the player decides to accept insurance, the process proceeds to step 208 where the player is requested to pay the insurance fee, which is half of the player's ante. The game process then proceeds to step 212. If, however, at step 204, the player decides not to purchase insurance, the game process proceeds to step 210, which indicates that the player declined insurance. At step 212, the dealer deals two cards to the player and one common card for all the players of the game. The dealer may deal one card to each player then deal a common card or the dealer may deal two cards to each player then deal the common card. In the computer implementation, typically only one person plays and the table displayed on the screen only contains position indicators for antes, an insurance fee and cards for the one person. At step 216, the players must decide whether to continue to play or to fold. If the player elects to fold, the game is over and the player loses the ante and the insurance fee as indicated at step 226. If at step 216, the player decides to continue to play, the player places a second bet preferably equal to the ante bet as indicated at step 230. At step 232, the dealer deals another card to yield a four card hand.

At step 234, the player must decide to fold or to continue playing. If the player decides to fold, the process proceeds to step 244 where the game is over for the folding player and the dealer collects the insurance fees and wagers placed by the player. If however at step 234, the player elects to continue, the player places another bet in order to receive a card to make a five card hand at step 248. At step 250, the dealer deals a card to complete the player's five card hand. At step 254, the dealer determines whether the player wins. If the player wins, the process proceeds to step 272, in which the dealer pays the player a winning sum or amount according to the pay table and the amount of money bet by the player; and the dealer or house collects, at step 278, the insurance fee and fee for the sixth card. If, however, at step 254, the player did not win at step 256, the dealer determines whether the player was insured. If the player was not insured, the game is over for the player, and the dealer collects all wagers and fees made by the player as indicated at step 258. However, if at step 256, the player was insured, the player is offered a chance to buy a bonus card at step 260. If the player does not elect to buy a sixth card, the game is over for the player, and the player's money is collected by the dealer as indicated at step 264. However, if at step 260, the player decides to buy a sixth card, the player must pay an additional fee to buy the sixth card. The dealer deals the sixth card to the player. At step 270, the dealer determines whether the player wins. If the player wins, the process proceeds to step 272, and player is paid a winning sum or amount based upon a pay table; and the dealer collects fees at step 278. If, however, at step 270 the player did not win, the player loses all wagers, including the insurance fee as indicated at step 274.

While the present invention has been illustrated by the description of the preferred and alternative embodiments and while the embodiments have been described in detail, the scope of the appended claims is not limited to such detail. Additional advantages and modifications other than those discussed specifically herein are readily apparent to those skilled in the art. Accordingly, departures may be made from such details without departing from the spirit or scope of applicant's invention.

What is claimed is:

1. A method for a plurality of players to play a card game, comprising:

providing each of the plurality of players with an option to select from the group consisting of receiving insurance and declining insurance;

receiving an option selection from each of the plurality of players;

dealing a predetermined number of cards to each of the plurality of players, such that each of the plurality of players has a hand;

determining whether the hand of each of the plurality of players is a losing hand;

providing a bonus card to each of the plurality of players receiving insurance and having a losing hand; and determining whether each of the plurality of players has a winning hand;

wherein the card game comprises a game played in accordance with poker rules; and wherein receiving the option selection from each of the plurality of players selecting to receive insurance comprises receiving an insurance fee from each of the plurality of players selecting to receive insurance.

2. The method of claim 1, wherein providing a bonus card to each of the plurality of players receiving insurance and having a losing hand comprises receiving a fee from each of the plurality of players receiving insurance and having a losing hand.

3. The method of claim 1, wherein providing each of the plurality of players with an option to select from the group consisting of receiving insurance and declining insurance occurs prior to dealing a predetermined number of cards to each of the plurality of players.

4. The method of claim 1, further comprising receiving an ante from each player.

5. The method of claim 4, wherein the insurance fee has a value, wherein the ante has a value, and wherein the value of the insurance fee is one half the value of the ante.

6. The method of claim 1, further comprising:

receiving from each of the plurality of players a selection from the group consisting placing a wager and folding.

7. The method of claim 1, wherein determining whether each of the plurality of players has a losing hand comprises comparing the hand of each of the plurality of players to a plurality of predetermined hands, each of the plurality of predetermined hands having an associated payout value; and wherein determining whether each of the plurality of players has a winning hand comprises:

determining a best hand for each of the plurality of players receiving the bonus card, the best hand including a predetermined number of cards, the predetermined number of cards being selected from the cards dealt to the player and the bonus card; and comparing the best hand to a plurality of predetermined hands, each of the plurality of predetermined hands having an associated payout value; and for each of the plurality of players not receiving the bonus card, comparing the player's hand to a plurality of predetermined hands, each of the plurality of predetermined hands having an associated payout value.

8. The method of claim 1, further comprising:

dealing a community card face up for optional use by each of the plurality of players, wherein the hand of each of the plurality of players includes the community card;

wherein determining whether each of the plurality of players has a losing hand comprises comparing the hand of each of the plurality of players to a plurality of predetermined hands, each of the plurality of predetermined hands having an associated payout value;

wherein determining whether each of the plurality of players has a winning hand comprises determining a best hand for each of the plurality of players; wherein the best hand for each of the plurality of players receiving the bonus card includes a predetermined number of cards, the predetermined number of cards selected from the hand of each of the plurality of players receiving the bonus card, and the bonus card; and wherein the best hand for each of the plurality of players not receiving the bonus card includes the hand of the player.

9. The method of claim 1, wherein dealing each of the predetermined number of cards to each of the plurality of players comprises:

dealing a first card of the predetermined number of cards to each of the plurality of players;

receiving from each of the plurality of players a wager option, the wager option being selected from the group consisting of placing a wager and folding; and repeating dealing and receiving the wager option until all of the predetermined number of cards are dealt to each of the plurality of players not folding.

10. The method of claim 1, wherein determining whether each of the plurality of players has a winning hand comprises comparing the hand of each of the plurality of players to a plurality of predetermined hands, each of the plurality of predetermined hands having an associated payout upon occurrence, further comprising paying each of the plurality of players having a winning hand the associated predetermined payout.

11. The method of claim 10, wherein each of the plurality of predetermined hands has a likelihood of occurrence, and wherein the associated payout of each of the plurality of predetermined hands varies depending on the likelihood of occurrence.

12. The method of claim 1, wherein receiving insurance comprises receiving an option to receive the bonus card.

13. The method of claim 1, wherein declining insurance comprises declining an option to receive the bonus card.

14. The method of claim 1, wherein determining whether the hand of each of the plurality of players is a losing hand comprises revealing each player's hand for the plurality of players.

15. The method of claim 14, wherein the hand of each of the plurality of players is revealed to a dealer.

* * * * *